United States Patent [19]

Frangipane

[11] 3,951,619

[45] Apr. 20, 1976

[54] METHOD OF MAKING A GRINDING WHEEL

[76] Inventor: Joseph G. Frangipane, 312 Graham Drive, Clearwater, Fla. 33515

[22] Filed: Oct. 21, 1974

[21] Appl. No.: 516,642

Related U.S. Application Data

[63] Continuation-in-part of Ser. No. 359,314, May 11, 1973, abandoned.

[52] U.S. Cl. ..... 51/308; 51/206 P

[51] Int. Cl.[2] ..... B24B 1/00

[58] Field of Search ..... 51/207, 206 P, 293, 51/295, 298, 308; 264/67, 162

[56] References Cited

UNITED STATES PATENTS

| | | | |
|---|---|---|---|
| 1,000,813 | 8/1911 | Johnson | 51/207 |
| 1,045,016 | 11/1912 | George | 51/206 P |
| 2,144,987 | 1/1939 | Miller | 51/206 P X |
| 2,691,806 | 10/1954 | Janes | 264/67 X |
| 3,395,204 | 7/1968 | Olsson | 264/67 X |
| 3,622,288 | 11/1971 | Rue | 51/295 |

FOREIGN PATENTS OR APPLICATIONS

| | | | |
|---|---|---|---|
| 1,116,027 | 10/1961 | Germany | 51/207 |
| 261,227 | 11/1926 | United Kingdom | 51/206 P |

*Primary Examiner*—Al Lawrence Smith
*Assistant Examiner*—Nicholas P. Godici
*Attorney, Agent, or Firm*—Robert F. Ruemeli

[57] ABSTRACT

A grinding wheel has a series of deep and narrow circumferential grooves between circular grinding sections having radially convex surfaces for forming serrations in a knife edge. The grooves are filled with a non-abrasive substance to strengthen the wheel and prevent a build-up of grinding off-fall as well as providing an indication by sound and feel when grinding of the serrations in a knife edge is completed. One embodiment has a plurality of abrasive discs mounted on a holder with smaller diameter non-abrasive discs between each of the abrasive discs, to form grooves therebetween. The holder forms a hub for mounting the assembled wheel on a spindle. A second embodiment has a vitrified abrasive which is pressed to form a blank with a cylindrical outer surface and a hub portion for receiving a spindle. The blank is fired to a relatively low temperature so that it may be mounted on a spindle as narrow annular grooves are cut through its cylindrical surface, and the outer faces of the abrasive sections between the grooves are dressed to a convex radius half the thickness of the abrasive sections. The grooves are then filled with a non-abrasive material to a diameter less than that of the abrasive sections and the wheel is fired to a relatively high temperature to give the abrasive sections desired hardness.

11 Claims, 5 Drawing Figures

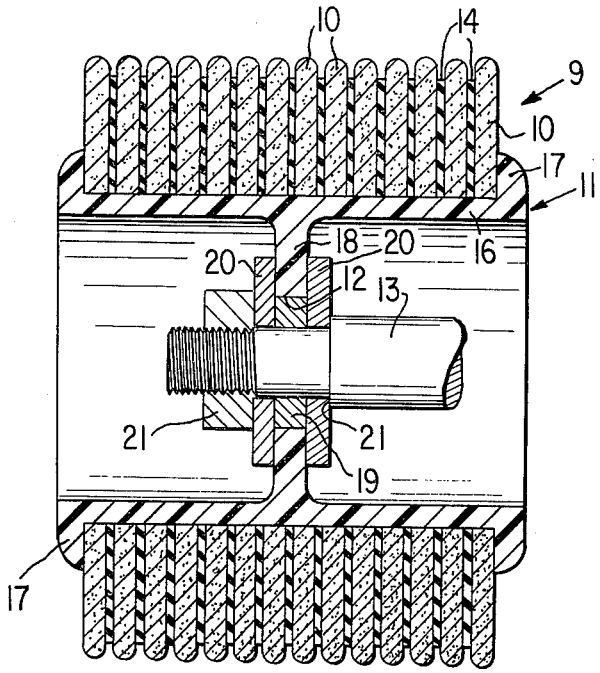
FIG. 1
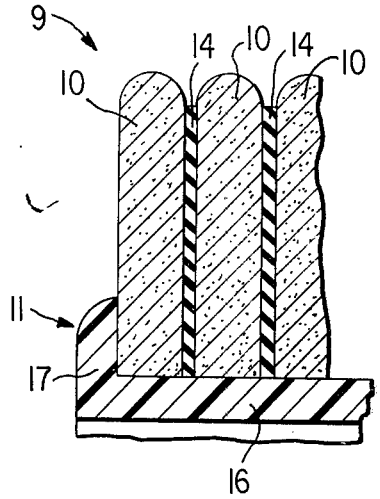
FIG. 2
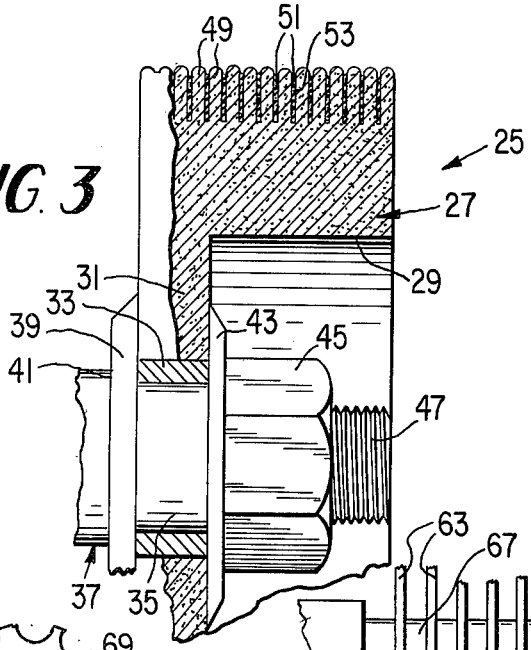
FIG. 3
FIG. 4
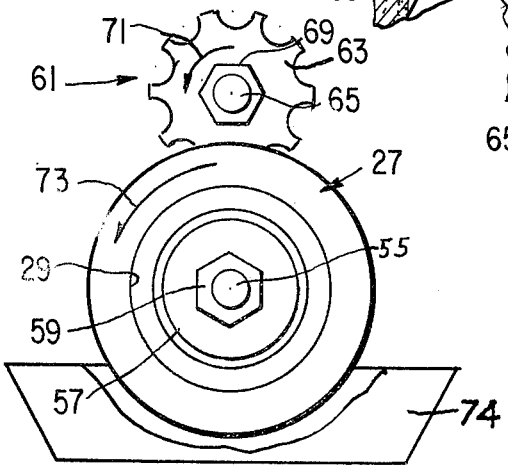
FIG. 5
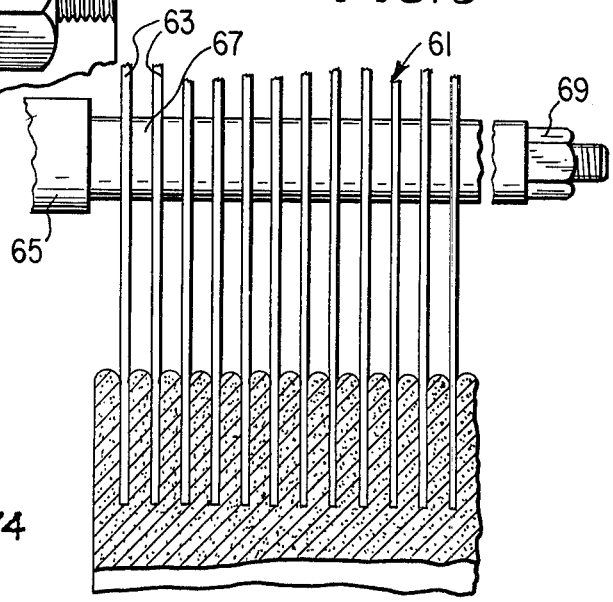

METHOD OF MAKING A GRINDING WHEEL

This application is a continuation in part of my copending application Ser. No. 359,314, filed May 11, 1973, now abandoned.

This invention relates to a method of making grinding wheels and, more particularly, to wheels for serrating knives.

BACKGROUND OF THE INVENTION

A conventionally ridged grinding wheel initially contacts a work piece at the outer most portion of the ridges of the grinding surface. Since there is no contact between the valley portions of the grinding wheel and the work piece until the work piece has been ground to a substantial depth by the ridges, the ridges are subjected to wear during the entire grinding operation, whereas the valley portions are subject to wear only after grinding of the work piece is substantially completed. This action normally causes rapid wear of the ridges resulting in a consequent necessity for frequent re-dressing of the grinding wheel. Wear of the ridges causes them to lose their desired shape, requiring frequent redressing of the wheel if a particular configuration of the ridges is essential.

It is well known to produce a series of scallops or grooves, commonly called serrations, along knife edges and similar articles, by means of grinding wheels having a surface configuration complementary to the final shape of the serrations in the knife. Heretofore, the expense of frequent re-dressing to restore the desired shape of the ridges of the grinding wheel has been substantial, to such an extent that the cost has frequently precluded the use of serrations or other grooved surfaces or edges where they would be desirable.

It is well known that the common cylindrical surface of a grinding wheel normally becomes convexly arched with continued use and must be dressed from time to time in order to restore the desired cylindrical grinding surface. With grinding wheels having a series of circumferential ridges along their grinding surface, the ridges flatten out during use. Upon continued use of the wheel the entire grinding surface begins to arch convexly. Thus, such ridged wheels must be frequently re-dressed to restore the desired configuration of the ridges.

A "Tooling Device for Stone and the Like" is shown in a patent granted in 1911, U.S. Pat. No. 1,000,813, in which a series of abrasive discs are mounted on a rotary shaft, each of the discs having a convexly arched grinding surface which together form a corrugated or crimped surface for providing a fluted surface on a work piece such as a stone, to resemble a tooling effect. During continued use of the assembled discs, the ridges will be flattened and it will be necessary to re-dress the discs in order to obtain the desired tooling effect.

A "Sharpening Device for Bush Hammers" is shown in a 1912 patent, U.S. Pat. No. 1,045,016. A series of convexly beveled, V-shaped grinding surfaces are spaced slightly apart by paper discs and are clamped together by wooden discs at either end, the wooden discs being clamped between a nut and a stop collar held by a set screw. Aside from the series of discs being likely to loosen, the V-shaped ridges will lose their points and the abrasive segments will become arched so that re-dressing will be required. Also, the paper discs are likely to be ripped apart when engaged by the points formed on the work piece during the grinding operation.

A cylindrical surfaced grinding wheel having an annular groove is shown in a 1946 patent, U.S. Pat. No. 2,396,505. The stated function of the groove is to relieve stresses during grinding of a resilient work piece and to equalize wear of the grinding surfaces. Typically, the cylindrical grinding surfaces can be expected to become arched during continued use. The wheel is manufactured by filling one half of a cylindrical mold and then placing a pair of semi-cylindrical metal spacing plates on top of the abrasive fill, then filling the rest of the mold with the abrasive fill and pressing the abrasive fill. Finally, the semi-cylindrical plates may be removed, thus forming the groove.

"Grinding or Polishing Rollers for Glass and the Like" is shown in a British patent accepted in 1926, British Pat. No. 261,227, in which cylindrical cast iron or Carborundum rollers, or the like, are provided with grooves. The grooves are not filled and are intended to permit water to flow away from the cylindrical surfaces for removing grinding or polishing substances.

Additional patents of a generally related nature include: U.S. Ser. No. 925,546; U.S. Pat. Nos.: 1,963,154, 1,975,070, 1,984,936, 2,079,787, 2,467,596 and 2,705,194.

THE INVENTION, IN BRIEF

It is a primary object of this invention to provide a new and useful method of making a grinding wheel.

Another object is provision of a new and useful method of making a grinding wheel comprising the steps of, providing an abrasive grinding wheel body, setting the body to a sufficient hardness which permits cutting into the body grooves substantially deeper than wide to define spaced apart sections, and of such hardness which permits subsequent setting of the body to a greater hardness of a finished grinding wheel while maintaining the sections and grooves intact, cutting the grooves into the body to define the spaced apart grinding sections, and after cutting the grooves setting the body to said greater hardness. A related object includes the step of forming generally convexly arched grinding surfaces on the sections and, more particularly, forming the grinding surfaces as generally semi-circular arches. Still another related object is provision for setting the wheel to said greater hardness following forming of the grinding surfaces. Further related objects include: cutting the grooves to a width in the range of about five-thousandths to fifteen-thousandths inch; cutting the grooves to a depth of about three-eighths inch; and cutting the grooves spaced apart to provide the grinding sections with a width of about ninety-five-thousandths inch. A more specific related object is providing an abrasive grinding wheel body having a diameter of about 6 inches, cutting the grooves into the body to a width in the range of about five-thousandths to fifteen-thousandths inch and a depth of about three-eighths inch and spaced apart to define the grinding sections with a width of about ninety-five-thousandths inch, setting the body by heat setting, and including the step of at least partially filling the grooves with a relatively non-abrasive material, when compared with the abrasive body, prior to setting the body to said greater hardness.

The invention, in brief, is directed to a method of making a grinding wheel. The wheel has a plurality of abrasive grinding sections having convexly arched grinding surfaces and deep circumferential grooves between the sections, the grooves being filled with a relatively non-abrasive material. The convexly arched grinding surfaces of the sections are preferably formed to a radius half the diameter of the width of the sections.

An abrasive grinding wheel body is set to a sufficient hardness to permit cutting into the body grooves substantially deeper than wide to define spaced apart sections and of such hardness which permits subsequent setting of the body to a greater hardness of a finished grinding wheel while maintaining the sections and grooves intact, cutting the grooves into the body to define the spaced apart grinding sections, and after cutting the grooves, setting the body to said greater hardness. The grooves are preferably cut to a width in the range of about five-thousandths to fifteen-thousandths inch and a depth of about three-eighths inch, with the grooves spaced apart to provide sections having a width of about ninety-five-thousandths inch in a wheel having a diameter of about 6 inches. The grinding sections may be formed with generally convexly arched grinding surfaces, and, preferably, generally semi-circular grinding surfaces, with the grinding wheel body being preferably set to the greater hardness after forming of the arched grinding surfaces.

Additional objects and advantages of the invention will be apparent in the following description and the accompanying drawing.

BRIEF DESCRIPTION OF THE DRAWING

FIG. 1 is a schematic, diametrical sectional view of an embodiment a grinding wheel of the invention;

FIG. 2 is an enlarged, fragmentary sectional view of a portion of FIG. 1;

FIG. 3 is a fragmentary, schematic, diametrical sectional view of a preferred embodiment of the grinding wheel;

FIG. 4 is a schematic end view, illustrating a grooving step during manufacture of the wheel shown in FIG. 3; and FIG. 5 is an enlarged, fragmentary, schematic side view of FIG. 4.

DESCRIPTION OF THE ILLUSTRATED EMBODIMENTS

Referring to FIGS. 1 and 2 of the drawing, a grinding wheel 9 has a group of similar annular abrasive grinding sections or discs 10 apertured for mounting on a hub 11 which includes a bore 12 mounted for rotation on a driving shaft 13. Each of the grinding discs 10 has its outer circumferential surface convexly arched and, more particularly, arched along a radius equal to half the thickness of the grinding discs 10. Grinding discs 10 have a diameter of about 6 inches and the overall width of the grinding surface of the wheel 9 being about 2½ inches.

Each grinding disc 10 is separated from the adjacent grinding discs by a relatively non-abrasive separator 14 of less diameter to provide grooves between the discs 10. The proportion between the thickness of the grinding discs 10 and the separator disc 14 may be as desired for the intended function of the grinding wheel. For serrating the edges of steak knives, for example, the width proportion of the grinding discs 10 to the separator discs 14 is about 19 to 1 and, more particularly, for grinding 10 serrations per inch each grinding segment 10 should be 0.095 inch in thickness and the separator discs 14 should be about 0.005 inch in thickness. A suitable adhesive, such as a rubber cement, may be utilized to form a mechanical bond between the discs 10 and 14 and between the discs and the drum 16 and flanges 17.

The hub 11 is preferably made of a durable plastic of the polyvinyl chloride type, and has a drum 16 proportioned to fit closely within the inside diameters of the discs 10 and 14, with flanges 17 of the hub fitting tightly over the outside grinding discs 10. The hub 11 has a central web 18 fitted with an annular metal bushing 19 for a snug sliding fit on the shaft 13 between a pair of rigid washers 20, one of the washers being seated against a shoulder 21 on the shaft 13 and the other washer being seated against a nut 21 threaded onto the free end of the shaft 13 and firmly clamping the hub 11 onto the shaft.

The non-abrasive separator discs 14 perform several functions. Their chief function is to wear away at a faster rate than the grinding discs 10 in order to maintain a suitable desired difference between the outer diameter of the abrasive discs and the outer diameter of the separator discs.

Another function is to signal by a change in the "feel" and/or the sound of the grinding operation, when the grinding operation has proceeded to a desired stage, that is, the work piece has been serrated to the desired depth. At this time the projecting portions of the serrations of the work piece have their very first contact with the separator discs 14. This contact with the separator discs 14 produces a slight rubbing vibration which feels and sounds different from the preceding abrasive action of the grinding disc 10.

The method of making the grinding wheel 9 includes, by way of example and not limitation, providing 25 grinding discs 10 with the outside circumference of these discs convexly arch, preferably to a radius of half that of the thickness of the discs. Also, providing 24 separator discs 14 either coated with a waterproof adhesive such as rubber cement or, alternatively, made of material which has previously been impregnated with a suitable waterproof adhesive. The grinding discs 10 and the separator discs 14 are then alternately placed on a mandrel which closely fits the inside diameter of the discs. This assembly is then cured by being placed in a press and held under adequate pressure to achieve a suitable desired compression and final thickness of the separator discs 14. This pressure is continued from 1 to 20 minutes, depending on the curing characteristics of the adhesive, plus the porosity of the grinding discs 10 and the separator discs 14, and this time may vary depending on ambient temperature.

After curing, the assembled stack is next slipped over the adhesive coated drum 16 of the hub 11. The flanges 17 are formed thereon by heat and pressure as is well known in the plastics art. Alternatively, the assembled stack may by inserted into a mold and the hub 11 molded directly onto the stack.

It has been found that grinding wheels made by the described method retain the desired radial configuration of the ridges of the outer circumferential surfaces of the discs 10. The discs 10 retain their radial ridged configuration as their diameter is progressively reduced during use, thereby eliminating the periodic re-dressing as has heretofore been necessary.

Thus, the described shape of the working faces of the grinding discs 10 provides a desirable relationship for the retention of the radial configuration throughout the wearing life of the grinding wheel. It has been found that without the separator discs 14, the arched configuration of the outer circumferential surface of the grinding discs 10 eventually flatten out into a generally cylindrical configuration, as previously discussed. As the outer diameters of the grinding discs 10 are reduced, the outer diameters of the separator discs 14 are also reduced as the work piece cuts into the separator disc 14, thus retaining discreet grooves between the grinding discs 10.

Referring to FIG. 3 of the drawing, a grinding wheel 25 is illustrated in the form of a generally cylindrical, integral abrasive body 27 having opposed generally cylindrical hollows 29 with a web 31 between the hollows. A central hole in the web 31 snugly receives a suitable metal bushing 33 which in turn is snugly received on a reduced portion 35 of the spindle shaft 37 and is seated against a rigid metal washer 39 telescoped on the reduced portion 35 of the shaft and seated against a shoulder 41 of the shaft. A similar washer 43 is positioned on the reduced portion 35 of the shaft and the assembly is firmly clamped on the shaft by a nut 45 threaded onto a reduced end portion 47 of the shaft 37.

In this embodiment, the one piece abrasive grinding body 27 has a generally cylindrical grinding surface formed into a series of grinding segments or sections 49, each section separated from the other by grooves 51. The outer cylindrical faces of the grinding segments 49 are formed with a convexly arched, preferably radial configuration, as previously described, and the grooves 51 are filled with a relatively non-abrasive filler 53 to the point at which the radial configuration of the grinding segments 49 begins. As previously mentioned with reference to the embodiment of FIGS. 1 and 2, the abrasive sections 49 and the grooves 51 may be proportioned as desired for the intended function of the grinding wheel, as for serrating knife edges, for example.

In both embodiments, the abrasive portion of the wheels may be of any desired abrasive composition. A preferred vitrified composition is as follows:

| | |
|---|---|
| Pure white aluminum oxide, 100 grit size | 1,362 grams |
| Feld spar | 153 grams |
| Ball clay | 175 grams |
| Borax | 55 grams |
| Low melting frit | 30 grams |
| Tragacanth solution | 75 grams; and |
| Coloring agent | 18 grams. |

Composition, by weight, of the filler material is preferably as follows:

| | |
|---|---|
| Ball clay | 35%; and |
| Fine alumina | 65%; |

and is mixed to a slurry.

The method of manufacturing the vitrified grinding wheel shown in FIG. 3 preferably includes the following steps. First, the above composition is molded and pressed as is well known in the art, to form the grinding wheel body 27. The wheel is heat set in typical manner, first to a relatively low temperature of about 1500°F, so that the body melts and upon setting is soft enough for cutting the grooves 51 and dressing the outer circumferencial grinding surfaces of the sections 49, while avoiding crumbling of the body 27.

With reference to FIG. 4 and 5, upon cooling of the body 27 it is mounted on a spindle shaft 55 and is suitably clamped in place between washers 57 by a nut 59, generally as previously described with reference to FIG. 3. A cutter 61 is mounted above the spindle shaft 55 and includes a plurality of circular notched blades 63 suitably mounted on a spindle shaft 65 with spacers 67 of a thickness exactly that of the desired thickness of the abrasive sections 49, the blade assembly being suitably clamped in place by a nut 69 on a threaded end of the shaft 65.

As indicated by the arrow 71 in FIG. 4, the cutter assembly is rotated counter-clockwise at about 17 R.P.M. and is moved downwardly into engagement with the body 27 to cut the grooves. The blades 63 are preferably 2½ inches in diameter and 0.005 inch thick, and of any suitable blade material. The spacers 67 are approximately 1 inch in diameter. The grinding wheel body 47 is rotated counter-clockwise as indicated by the arrow 73 in FIG. 4 and at about 7 R.P.M. so that the cutting blades 63 and the grinding wheel body 27 move in opposite directions at their points of contact and at any suitable speeds to avoid excessive wear of the blades. The grinding wheel body is rotated in a trough 74 of coolant to facilitate cutting and to wash out offfall.

After the grooves 51 are cut into the grinding wheel body 27, the arched configuration of the grinding surfaces of the abrasive segments 49 are formed in typical manner known in the art.

Next, the grinding wheel 25 is cleaned of loose material, which may be accomplished in any suitable manner as by blowing. The wheel is placed in a tank and under vacuum, and the filler material is inserted into the tank to fill the grooves 51. The wheel is then removed from the tank and the excess filler is washed off the wheel leaving the grooves filled to approximately 0.047 inch inwardly of the outside diameter of the abrasive segments 49.

The grinding wheel is then heated a second time to a higher temperature of approximately 1915° F for 8 hours, whereupon the wheel is at the desired stage of hardness for serrating typical knife edges.

Alternatively, the filler can be a rubber-like compound in which event the grooves are filled with powdered alumina to keep the thin sections 49 from warping when fired the second time. After the second firing the alumina is blown out of the grooves and the rubber compound is then inserted into the grooves to the depth previously described.

In summary, the grooves provided by the separator discs 14 (FIGS. 1 and 2), and the grooves 51 (FIG. 3) permit limited portions of the work piece to enter into the open outer portions of the grooves and to contact only the non-abrasive (or relatively non-abrasive material of the discs 14 (FIG. 1 and 2) or the filler 53 (FIG. 3). Thus, further abrasive action from the abrasive section on the grooves (10 FIGS. 1 and 2, or 49 FIG. 3) on these limited portions of the work piece is effectively prevented, and the radii on the outer grinding faces of the abrasive sections retain their generally radial configuration through continued use. Additionally, the separator discs 14 (FIGS. 1 and 2) and the filler 53 (FIG. 3) support the abrasive sections and strengthen the wheels.

In both embodiments of the grinding wheel, the grooves are preferably five-thousandths of an inch wide (axially of the wheel) in order to avoid forming long points between the scallops of the serrated knife edge. However, in practice the grooves may have a width of up to fifteen-thousandths of an inch, but a width greater than this tends to cause the formation of flats along the serrated edge. Thus, a critical width of the grooves has been found to be between five-thousandths and fifteen-thousandths of an inch, with a five-thousandths inch groove being preferable.

While this invenion has been described with reference to particular embodiments in a particular environment, various changes may be apparent to one skilled in the art and the invention is therefore not to be limited to such embodiments or environment except as set forth in the appended claims.

what is claimed is:

1. A method of making a grinding wheel comprising the steps of, providing an abrasive grinding wheel body, setting the body to a sufficient hardness which permits cutting into the body grooves substantially deeper than wide to define spaced apart sections and of such hardness which permits subsequent setting of the body to a greater hardness of a finished grinding wheel while maintaining the sections and grooves intact, cutting said grooves into the body to define said spaced apart grinding sections, and after cutting the grooves setting the body to said greater hardness.

2. A method as set forth in claim 1 including the step of at least partially filling the grooves with a relatively non-abrasive material when compared with the abrasive body.

3. A method as set forth in claim 2 in which the step of setting the body to said greater hardness follows the step of filling the grooves, and the setting steps include heat setting the body.

4. A method as set forth in claim 1 including the step of forming generally convexly arched grinding surfaces on said sections.

5. A method as set forth in claim 4 in which the forming step comprises forming said grinding surfaces with generally semi-circular arches axially of the wheel.

6. A method as set forth in claim 5 in which the second setting step follows the forming step.

7. A method as set forth in claim 1 in which the cutting step comprises cutting said grooves to a width in the range of about five-thousands to fifteen-thousands inch.

8. A method as set forth in claim 7 in which the cutting step comprises cutting the grooves to a depth of about three-eighths inch.

9. A method as set forth in claim 7 in which the cutting step comprises cutting the grooves spaced apart to provide said sections with a width of about ninety-five-thousands inch.

10. A method as set forth in claim 1 in which grooves are spaced apart to define said sections having a width of about ninety-five-thousands inch.

11. A method as set forth in claim 1 in which the steps further comprise, providing an abrasive grinding wheel body having a diameter of about 6 inches, cutting said grooves into the body to a width in the range of about five-thousands to fifteen-thousands inch and a depth of about three-eighths inch and spaced apart to define said grinding sections of about ninety-five-thousands inch width, and setting the body by heat setting, and including the step of at least partially filling said grooves with a relatively non-abrasive material, when compared with the abrasive body, prior to setting the body to said greater hardness.

* * * * *